United States Patent [19]

McCoskey

[11] 4,375,177

[45] Mar. 1, 1983

[54] AUTOMATIC ELECTRONIC MUSICAL INSTRUMENT

[75] Inventor: James M. McCoskey, Santa Rosa, Calif.

[73] Assignees: John Larson, Sonoma, Calif.; Douglas Gustafson, Jerome, Ariz. ; part interest to each

[21] Appl. No.: 253,772

[22] Filed: Apr. 13, 1981

[51] Int. Cl.[3] ..... G10H 1/42; G10H 5/00

[52] U.S. Cl. ..... 84/1.03; 84/DIG. 12

[58] Field of Search ..... 84/1.03, 484, DIG. 12; 340/384 R, 384 E; 368/243, 250, 251

[56] References Cited

U.S. PATENT DOCUMENTS 4,208,938 6/1980 Kondo ..... 84/1.03

*Primary Examiner*—Stanley J. Witkowski

*Attorney, Agent, or Firm*—Willis E. Higgins; Julian Caplan

[57] ABSTRACT

An automatic electronic musical instrument generates structured and pleasing musical sound patterns from a random sequence. One phase of the random sequence is supplied to a first shift register. A first plurality of outputs from the first shift register is used to control a rhythm oscillator. A second plurality of outputs from the first shift register is used to control a pitch oscillator. A second shift register receives a second phase of the random sequence and the rhythm signal produced by the rhythm oscillator. A programmed control input provides a song structure to the outputs of the second shift register. The outputs of the second shift register are supplied as inputs to a musical frequency generating means which has the capability of transforming dissonant frequency combinations otherwise selected by those inputs to compatible frequency combinations. The musical frequency generating means also receives the pitch signal from the pitch oscillator. Use of two shift registers in this manner imposes sufficient repetition and structure on random inputs to produce pleasing melodies. If desired, a third shift register may receive a third phase of the random sequence to generate accompaniment chords for the melodies so produced.

15 Claims, 9 Drawing Figures

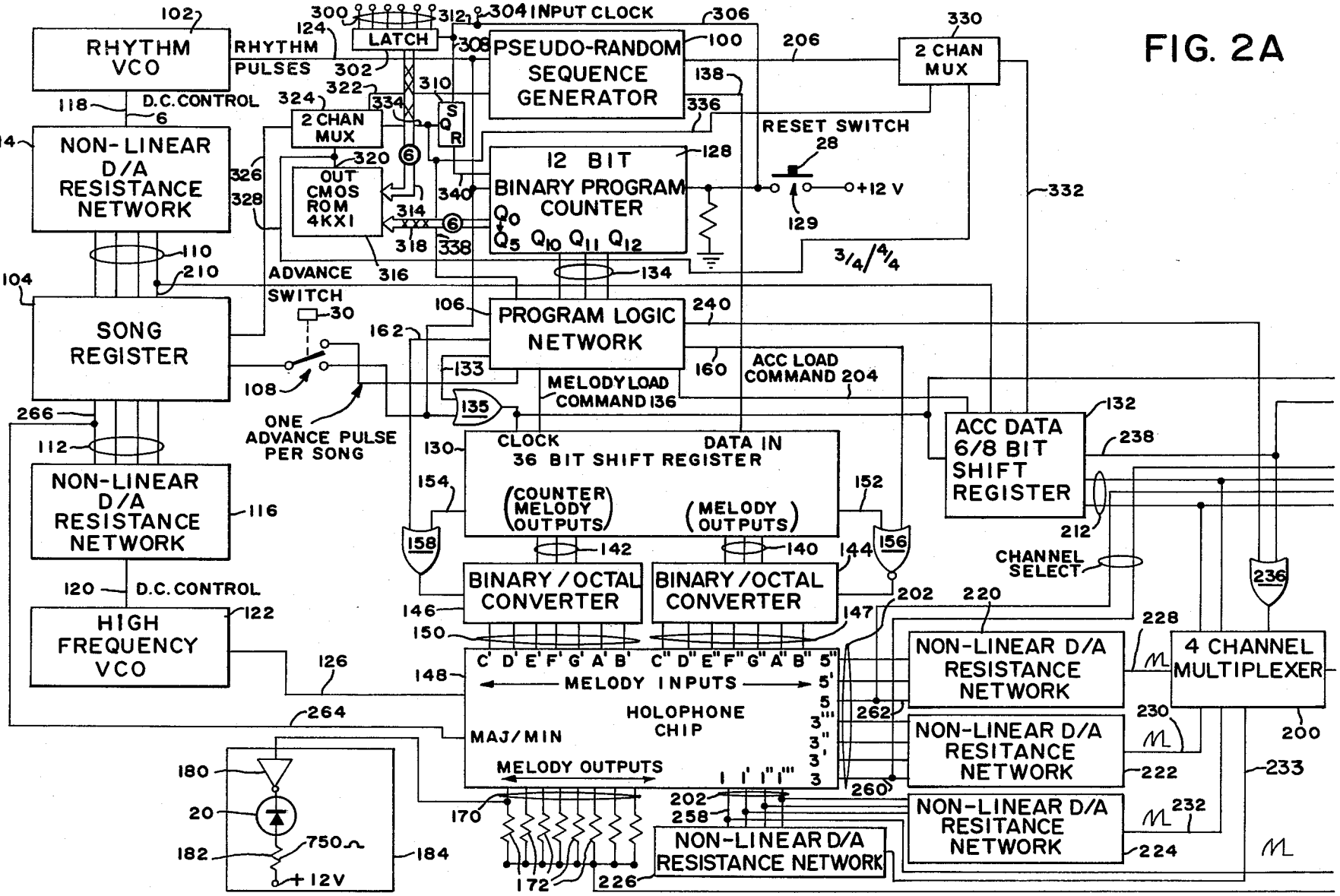
FIG. 2A
RHYTHM VCO
NON-LINEAR D/A RESISTANCE NETWORK
SONG REGISTER
NON-LINEAR D/A RESISTANCE NETWORK
HIGH FREQUENCY VCO
D.C. CONTROL
RHYTHM PULSES
2 CHAN MUX
OUT CMOS ROM 4KX1
LATCH
PSEUDO-RANDOM SEQUENCE GENERATOR
INPUT CLOCK
12 BIT BINARY PROGRAM COUNTER
RESET SWITCH
+12 V
3/4/4/4
2 CHAN MUX
PROGRAM LOGIC NETWORK
ADVANCE SWITCH
ONE ADVANCE PULSE PER SONG
MELODY LOAD COMMAND
ACC LOAD COMMAND
ACC DATA 6/8 BIT SHIFT REGISTER
CHANNEL SELECT
DATA IN
CLOCK
36 BIT SHIFT REGISTER
(MELODY OUTPUTS)
(COUNTER MELODY OUTPUTS)
BINARY/OCTAL CONVERTER
BINARY/OCTAL CONVERTER
NON-LINEAR D/A RESISTANCE NETWORK
NON-LINEAR D/A RESISTANCE NETWORK
NON-LINEAR D/A RESISTANCE NETWORK
4 CHANNEL MULTIPLEXER
HOLOPHONE CHIP
MELODY INPUTS
MAJ/MIN
MELODY OUTPUTS
NON-LINEAR D/A RESISTANCE NETWORK
12V
750Ω

CD 4040
12 BIT RIPPLE
COUNTER
$Q_{10}$ $Q_{11}$ $Q_{12}$
128
134
106
404
CD 4028
BINARY TO OCTAL CONVERTER
0 1 2 3 4 5 6 7
408 410 414 416 406
418 412 424 428 426 438 434
420 430 432 422 436
ADV PULSE
ACC LOAD COMMAND
MELODY LOAD COMMAND
ACCOMP INHIBIT
COUNTER MELODY INHIBIT
MELODY INHIBIT 116
100K
FROM SONG REG. Q's
112
120
TO HIGH FREQ. OSC. 122
3.9K

114
FROM SONG REG. Q's
110
118
TO RHYTHM OSC. 102
22K 220, 222a 224
AUDIO OUT TO 200
500K
300K
200K
III II I
OCTAVE I
FROM 148 ACC. SIGNALS

226
AUDIO OUT TO 200
1.2M
500K
300K
200K
IV III II I
OCTAVE I

+12V
240
22
242 244 246 248
250 252 254 256
214
174
A
176

AUTOMATIC ELECTRONIC MUSICAL INSTRUMENT

BACKGROUND OF THE INVENTION

1. Field of the Invention

This invention relates to a new type of electronic musical instrument. More particularly, it relates to an automatic electronic musical instrument which utilizes random inputs to produce pleasing musical sounds having a structured pattern in a non-repeating series of songs.

2. Description of the Prior Art

There are a wide variety of electronic musical instruments known in the art, including electronic organs, synthesizers and portable electronic musical instruments of the type described in McCoskey et al, U.S. Pat. No. 4,178,823, issued Dec. 18, 1979. Such prior art electronic musical instruments utilize either a plurality of oscillators or frequency divider networks for producing musical output frequencies in response to keyboard closures or other inputs, which select frequencies corresponding to desired musical sounds.

In addition to selecting the desired musical frequencies by the manual playing of a keyboard, it is also known to use a computer program for the selection of the frequencies to produce the musical output in accordance with a desired pattern. However, the preparation of such programs for controlling the output of an electronic musical instrument is laborious and time consuming, as well as requiring both a high level of technical sophistication and musical knowledge. As a result, users of prior art electronic musical instruments must either develop the ability to play the instrument manually in a manner comparable to any other type of musical instrument or provide a different program for each different composition to be played.

SUMMARY OF THE INVENTION

Accordingly, it is an object of this invention to provide an electronic device for generating pleasing musical sound patterns automatically, without requiring the use of a pre-recorded performance, a broadcast input, or a different program for each different song to be produced.

It is another object of the invention to provide an electronic musical instrument that generates structured and constantly varying musical sound patterns automatically, without requiring user programming.

It is a further object of the invention to provide an automatic electronic musical instrument which utilizes an essentially random input to produce structured song patterns.

It is still another object of the invention to provide an automatic electronic musical instrument in which a structured and non-repetitive melody and an accompaniment for the melody are generated from a random sequence signal.

The attainment of these and related objects may be achieved through use of the novel automatic electronic musical instrument herein disclosed. This musical instrument includes a means for generating a random sequence output signal. As used herein, the term "random sequence output" encompasses not only outputs of different values, each having an equal probability of occurring, but so called pseudo-random outputs as well, in which certain output values are somewhat more likely to occur than other values, but which outputs appear to lack any definite pattern. A first shift register has an input connected to receive a first phase of the random sequence output signal from the random sequence output signal generating means. The first shift register has a first and second plurality of outputs. A means, connected to receive input signals from the first and second plurality of outputs of the first shift register, generates rhythm and pitch signals in response to the input signals. A second shift register is connected to receive a second phase of the random sequence output signals from the random sequence output signal generating means, and the rhythm signal from the rhythm and pitch signal generating means. The second shift register also has a plurality of outputs, which are connected to supply selection signals to a musical frequency generating means. The selection signals from the second shift register serve to select frequencies generated by the musical frequency generating means for use in making musical tones. The musical frequency generating means is also connected to receive the pitch signal from the rhythm and pitch signal generating means. The musical frequency generating means also includes means for transforming dissonant frequency combinations selected for tone generation to compatible frequency combinations. An inhibiting means selectively inhibits the selection signals to the musical frequency generating means from the plurality of outputs of the second shift register in accordance with a pre-determined pattern.

Use of two shift registers and an inhibiting means which operates in accordance with a pre-determined pattern in this manner imposes a sufficient amount of regularity and structure on the selected musical frequencies provided as outputs from the musical frequency generating means to produce pleasing melodies. This is necessary because a simple random sequence of notes is not musically pleasing, no matter how harmonious these notes are with respect to one another.

If desired, a third shift register can be connected to receive a third phase of the random sequence output signal from the random sequence output signal generating means, with output signals from the third shift register controlling selection of accompaniment frequencies from the musical frequency generating means for the musical frequencies selected by the selection signals from the second shift register.

The attainment of the foregoing and related objects, advantages and features of the invention should be more readily apparent after review of the following more detailed description of the invention, taken together with the drawings, in which:

DETAILED DESCRIPTION OF THE INVENTION

Figure 1:
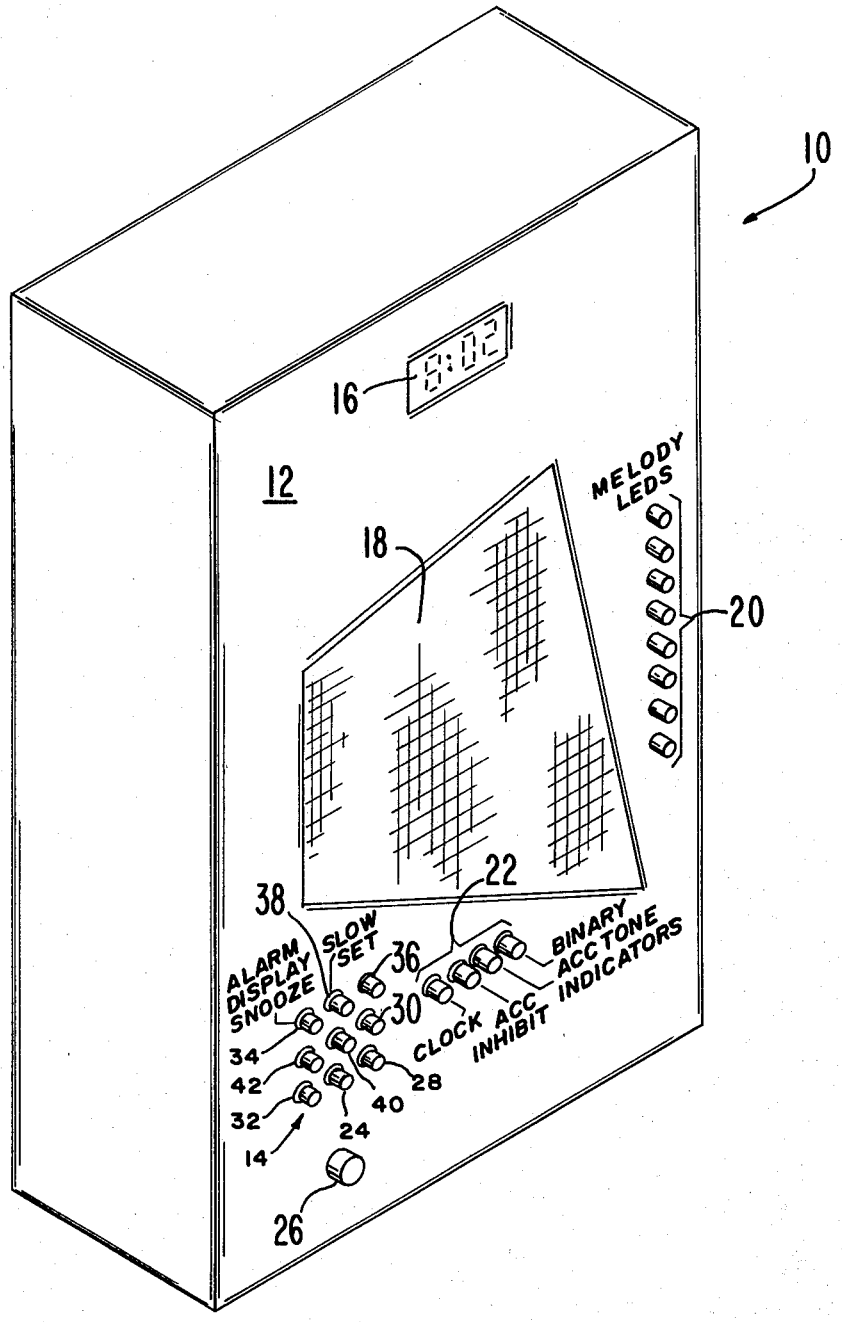
FIG. 1 is an external perspective view of an automatic electronic musical instrument in accordance with the invention, showing its front panel.

Turning now to the drawings, more particularly to FIG. 1, there is shown an automatic electronic musical instrument in accordance with the invention. Case 10 has a front panel 12, which includes controls 14 for the instrument, a digital display 16, speaker 18, and light emitting diodes (LED's) 20 and 22, for indicating certain functions of the instrument, to be explained below.

The controls 14 for the instrument include an on/off switch 24, a volume control 26, a song reset button 28, and an advance button 30. Since one use of the instrument of this invention is an alternative to a conventional alarm clock, additional controls are provided for the alarm function. Button 34 causes display 16 to show the time for which the alarm is set. Button 36 is for rapid setting of the time and button 38 is for slower setting of the time, used when the time shown on the display 16 is close to the desired indication. The display 16 ordinarily shows hours and minutes. Button 40 causes display 16 to show seconds. Button 42 causes display 16 to show the time remaining before the instrument turns on to carry out its alarm function.

Figures 2, 2A, 2B, 3, 4A, 4B, 4C, 4D:
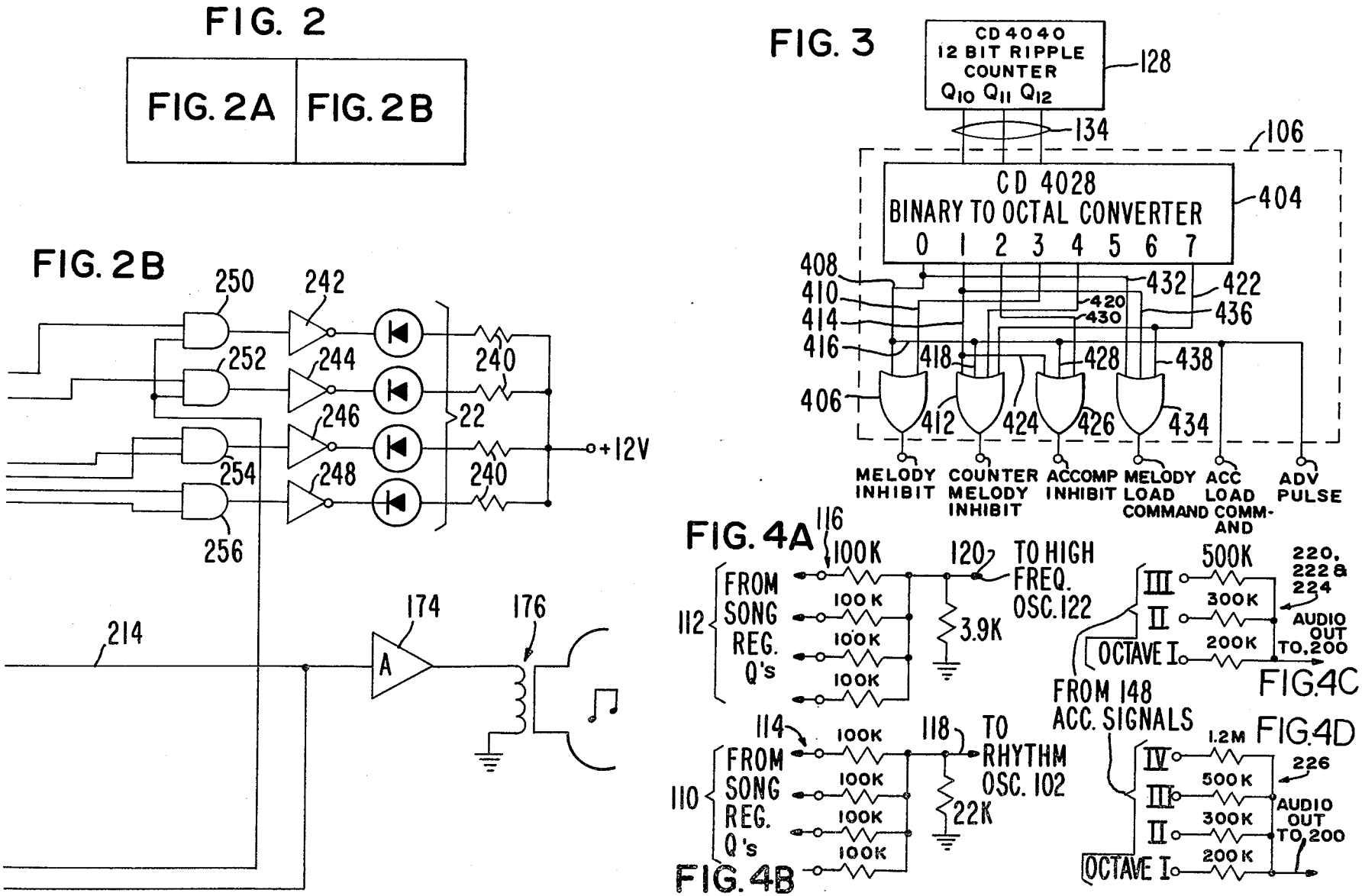
FIG. 2 is a key showing placement of FIGS. 2A and 2B.
FIGS. 2A and 2B are block diagrams of circuitry for the electronic musical instrument shown in FIG. 1.
FIG. 3 is a more detailed block diagram of a portion of the block diagram of FIG. 2A.
FIGS. 4A through 4D are circuit diagrams of portions of the block diagram of FIG. 2A.

FIGS. 2A and 2B show circuitry for the musical instrument of this invention in block diagram form and connect together as shown in FIG. 2 to depict the complete block diagram. A pseudo-random sequence generator 100 provides output signals which are used to generate most of the remaining signals in the system. The pseudo-random sequence generator may be fabricated from a commercially available 4006 type static shift register integrated circuit, configured as a 17 bit shift register and an exclusive OR gate. The 4006 type integrated circuit and all other integrated circuits identified by such part number types, except where otherwise noted, may be obtained from National Semiconductor Corporation, Santa Clara, Calif. 95051, and are described in a publication entitled "CMOS Data Book", published in 1977 and available from National Semiconductor.

The generator 100 is characterized as a pseudo-random sequence generator because, as configured, it repeats itself every 131,071 clock pulses. With such infrequent repetition, the practical effect to the user of the instrument incorporating such a generator is the same as if the generator 100 were truly random. The generator 100, of course, could be one that generates a true random sequence rather than a pseudo-random sequence. The generator 100 is preferably configured as shown in Lancaster, *CMOS Cookbook* (Indianapolis, Howard W. Sams & Co.), pages 318–323, the disclosure of which is incorporated by reference herein.

The pseudo-random sequence generator 100 is clocked by the output pulses from voltage controlled oscillator (VCO) 102. The generation of these pulses will be explained below. Each pulse generates an additional bit of the pseudo-random sequence.

A first phase of the pseudo-random sequence is supplied as a data input to an 8-bit shift register 104. The 8-bit shift register 104 may be implemented as a 4015 type dual 4-bit static register, configured as a single 8-stage register. The shift register 104 is ordinarily clocked by pulses supplied from program logic network 106, implemented as a programmable logic array (PLA). One clock pulse is provided for each song, as determined by the song program stored in the PLA 106, which will be discussed below. An advance switch 108 alternatively connects the clock input of the shift register 104 to receive the output pulses from oscillator 102, when it is desired to change the bit sequence in shift register 104 rapidly. Shift register 104 has a first group 110 of four parallel outputs and a second group 112 of four parallel outputs. These outputs respectively provide inputs to resistance networks 114 and 116.

The resistance networks 114 and 116 each provide one of 16 randomly selected direct current (DC) voltages at their respective outputs 118 and 120 on the basis of the randomly changing 4-bit outputs at 110 and 112 from shift register 104.

The DC signals at 118 and 120 respectively control VCOs 102 and 122. The VCOs 102 and 122 may be implemented with 4046 type integrated circuits. The frequency of the output oscillations at the respective outputs 124 and 126 of the VCOs 102 and 122 are determined by the control voltages at 118 and 120, respectively, and their frequency therefore also varies randomly.

In addition to supplying the clock input to pseudo-random sequence generator 100, the output oscillations from VCO 102, which constitute rhythm pulses for the system, also are supplied as the clock inputs to a program counter 128, 36-bit shift register 130 and 6- or 8-bit shift register 132. In order to allow alternative clocking by program logic network 106, output 124 of rhythm VCO and output 133 from the network 106 form inputs to OR gate 135. As further noted above, the rhythm pulses at output 124 are also available as an alternate clock input to the 8-bit shift register 104 when advance button 130 is depressed. The program counter 128 may be implemented as a CD4040 type 12-bit ripple counter.

The program counter 128 provides suitable control signals at outputs 134 to cause sequential execution of the program steps stored in PLA 106, which defines a song pattern structure to be produced by the instrument. Reset button 28 is connected to switch 129, which, when closed, supplies a 12 volt input to program counter 128, resetting it to the initial program step to start a different song. Output 136 of PLA 106 is connected to supply a load command to 36-bit shift register 130. The data input to shift register 130 is connected to receive a second phase of the pseudo-random sequence from output 138 of generator 100. If a "1" is supplied by PLA 106 on output 136, as determined by the program, shift register 130 loads a new pseudo-random sequence of 36 bits from output 138. If a "zero" is supplied at output 136, shift register 130 simply circulates the bit sequence it already contains at the oscillation frequency supplied at output 124. The 36-bit shift register may be implemented with two DC4006 type shift registers. Shift register 130 has first and second sets 140 and 142 of outputs, which supply information in binary form, respectively, to binary/octal converters 144 and 146. Binary/octal converter 144 supplies melody select signals at outputs 147 to musical frequency generation integrated circuit 148. Similarly, binary/octal converter 146 supplies countermelody information at outputs 150 to the musical frequency generation integrated circuit 148. Output 126 of VCO 122 provides a pitch frequency as a clock input to integrated circuit 148.

Additional outputs 152 and 154 from shift register 130 respectively provide one input of OR gates 156 and 158. The other inputs of OR gates 156 and 158 are respectively provided by outputs 160 and 162 from PLA 106. The state of outputs 160 and 162 from PLA 106 are determined by the program stored in PLA 106. The state of outputs 152 and 154 of shift register 130 are randomly varied, as determined by the information stored in the shift register 130. The outputs of OR gates 156 and 158 are respectively connected as inhibit inputs to the binary/octal converters 144 and 146.

The musical frequency generation integrated circuit 148 may be implemented with a commercially available PHC 1896 musical instrument frequency divider integrated circuit, available from Pacific Holophone Company, Round Mountain, Calif., 96084, which is described in its data sheet, also available from Pacific Holophone. Further details of this integrated circuit are described in the above-referenced U.S. Pat. No. 4,178,823, the disclosure of which is incorporated by reference herein. Since the melody and countermelody inputs to the musical frequency generation integrated circuit 148 are random in nature, the integrated circuit 148 must include circuits for transforming selected note combinations that would be dissonant to compatible combinations. The PHC 1896 type integrated circuit incorporates such transforming circuits, as described in the U.S. Pat. No. 4,178,823. Other musical frequency generation integrated circuits may be substituted for the PHC 1896 type integrated circuit, as long as they include such transformation circuits.

The melody outputs 170 of the musical frequency generation integrated circuit 148 are connected through resistors 172 as a common input to audio amplifier 174, the output of which drives a speaker 176 in a conventional manner to produce musical sounds in accordance with the melody and countermelody output frequencies. Each individual melody output 170 is also connected through an amplifier 180 to the LEDs 20, also shown in FIG. 1, in an LED circuit 184. A +12 volt source is also connected to each LED 20 through a resistor 182 as shown. Corresponding LED circuits 184 are connected to each of the melody outputs 170. Each of the LEDs 20 in circuits 184 are turned on when an output melody frequency is supplied to its corresponding melody output 170. The LED 20 flickers at the frequency of its corresponding melody output 170. While this flickering occurs at a frequency too high to be visually perceptible, the flickering may provide a subliminal effect, as well as indicating which output 170 is providing the melody frequency being heard from speaker 176.

In order to provide a suitable chord accompaniment for the melody frequencies supplied to audio amplifier 174 as explained above, multiplexer 200 selectively gates chord frequencies from outputs 202 of the musical frequency generation integrated circuit 148 under control of accompaniment shift register 132. In a similar manner to shift registers 104 and 130, output 204 of PLA 106 is connected to supply an accompaniment load command to the shift register 132. As in the case of shift register 130, shift register 132 is clocked by the rhythm pulse output 124 of VCO 102. When the accompaniment load command at output 204 is in the "1" state, shift register 132 loads a third phase of the pseudo-random bit sequence from output 206 of pseudo-random sequence generator 100. When the accompaniment load command is a "0", the shift register 132 recirculates the information it already contains, as in the case of shift register 130. Shift register 132 also selects a musical time for the songs to be played by the instrument. This is done by providing shift register 132 as a variable length 6-bit or 8-bit shift register. The 6- or 8-bit length is selected by an input from output 210 of shift register 104. If the 6-bit length is selected, a 3/4 time for a song is provided. If the 8-bit length is selected, a 4/4 time for the song is provided. The shift register 132 may be implemented as a 4015 type dual 4-bit static register integrated circuit.

Outputs 212 of the shift register 132 control which of the four input channels of multiplexer 200 are supplied at output 214 of the multiplexer 200 to amplifier 174. The chord outputs 202 of the musical frequency generation integrated circuit 148 are connected as inputs to resistance networks 220, 222, 224 and 226, as shown. Outputs 228, 230 and 233, respectively, of each resistance network 220–226 form the four input channels to the multiplexer 200. The shift register 132 may be implemented as a CD 4053 type integrated circuit in combination with a CD 4015 type static register to produce a register switchable in length, as well as switchable from a register fed by its own tail to one fed by line 332 in FIG. 2A. The multiplexer 200 may be implemented as a CD 4051 type integrated circuit.

The output of OR gate 236 provides an inhibit control for multiplexer 200. One input to OR gate 236 is provided by output 238 from shift register 132. The other input to OR gate 236 is provided by output 240 of PLA 106. The resulting inhibit commands from OR gate 236 provide song structure to the chord signals at output 214 of multiplexer 200.

LEDs 22 (also shown in FIG. 1) are provided to show the functioning of chord outputs 202 of the musical frequency generation integrated circuit 148, and the rhythm pulse oscillations at output 124 of oscillator 102. Each LED 122 is connected to a +12 volt source by resistors 240. The respective outputs of amplifiers 242, 244, 246 and 248 are each connected to one of the LEDs 22, as shown. The respective outputs of AND gates 250, 252, 254 and 256 are connected to the respective inputs of amplifiers 242–248. One input to AND gate 250 is provided by the rhythm pulse output 124 of VCO 102. The other input to AND gate 250 is provided by chord output line 258 of musical frequency integrated circuit 148, which also forms one input to AND gate 252. The other input to AND gate 252 is provided by the accompaniment inhibit output 238 of shift register 132. The two channel select outputs 212 of shift register 132 provide one input to each of AND gates 254 and 256. The other input to AND gate 254 is provided by chord output line 260 of the integrated circuit 148, and the other input to AND gate 256 is provided by chord output line 262 of the integrated circuit 148.

The PHC 1896 type integrated circuit includes an input 264 for selecting either a major key or a minor key for the melody and chord outputs 170 and 202. The input 264 is connected to output line 266 of the shift register 104. Since the outputs 112 of shift register 104 vary randomly, half the time a major key will be selected and half the time a minor key.

The PLA 106 uses the binary outputs 134 from the program counter 128 to divide each song into 8 temporal segments. The PLA 106 controls the operation of the instrument during a song by turning on or off six binary variables at the beginning of each segment of time in accordance with a predetermined program stored in the PLA. While essentially any pattern for a song can be provided with the PLA program, one representative output pattern from a preferred PLA program is shown in the following table:

| Time Segment | 0 | 1 | 2 | 3 | 4 | 5 | 6 | 7 |
|---|---|---|---|---|---|---|---|---|
| Melody inhibit | 1 | 0 | 0 | 1 | 0 | 0 | 0 | 0 |
| Counter melody inhibit | 1 | 1 | 0 | 0 | 1 | 0 | 0 | 1 |
| Accompaniment inhibit | 1 | 1 | 1 | 0 | 0 | 0 | 0 | 0 |
| Melody load command | 1 | 1 | 0 | 0 | 0 | 0 | 0 | 1 |
| Acc. load command | 1 | 0 | 0 | 0 | 0 | 0 | 0 | 0 |
| Advance pulse | 1 | 0 | 0 | 0 | 0 | 0 | 0 | 0 |

As shown, during time segment zero, the melody load command, accompaniment load command and advance pulse are all in the "1" state. At this time, the three shift registers 104, 130 and 132 are loading different phases of the pseudo-random bit sequence from generator 100. No outputs are being provided from the shift registers during this time, and the instrument is therefore silent. During time segments 1 through 7 of the song, the different functions of the instrument are operating in accordance with the commands as shown. At the end of a song, the program counter returns to time segment zero, and information from a new pseudo-random sequence is loaded into the three shift registers 104, 130 and 132.

In addition to utilizing the pseudo-random output of generator 100 to generate songs in the instrument of FIGS. 2A and 2B, an external input supplied at 300 to latch 302 may also be used. For operation in this mode, an external clock input is also supplied at 304. Line 306 supplies the external clock input to reset program counter 128. Line 308 supplies the external clock input to the set terminal of RS flip-flop 310 and line 312 provides the external clock input to latch 302. Bus 314 supplies the contents of latch 302 as an address input to complementary metal oxide silicon (CMOS) read only memory (ROM) 316. ROM 316 contains patterns which produce a harmonically pleasing combination of sounds from the instrument when addressed. If a random access memory (RAM) were substituted for ROM 316, the instrument would be truly user programmable. Program counter 128 also supplies address inputs to the ROM 316 on bus 318. Depending on the addresses supplied on buses 314 and 318, ROM 316 provides an alternative output on line 320 to the output supplied by pseudo-random sequence generator 100 on line 322, both output lines 320 and 322 being connected to a two-channel multiplexer 324. Output 326 of multiplexer 324 constitutes an input to song register 104. The output from ROM 316 at 320 is also supplied on line 328 as one input to two-channel multiplexer 330, the other input of which is supplied by pseudo-random sequence generator 100 on line 206. Output 332 of the multiplexer 330 is supplied as the data input to shift register 132. The control inputs to multiplexers 324 and 330 are supplied by the Q output of RS flip-flop 310 on lines 334 and 336, respectively. The Q output of RS flip-flop 310 is also supplied to program logic network 106 by line 338. The reset terminal of RS flip-flop 310 is connected to program counter 128 by line 340.

In operation, the above-discussed external input furnishing means allows this electronic musical instrument to generate musically pleasing songs solely in response to the external signals, or, alternatively, with its own internally generated song patterns in any desired combination of externally and internally generated song patterns. The external input can be derived from essentially any external event, such as, for example, brain wave signals supplied by a suitable transducer. In a network of instruments capable of sending and/or receiving communications from one another or from a central source, certain combinations of musical sounds understood as information by those using the instruments could be used as a means of simultaneous code transmission to such users. Such communications could either be human-to-human or machine-to-machine, or any combination thereof. The use of an external input to the instrument also offers a unique way for musicians to jam with the instrument of this invention, in which an input supplied by the musician by playing another instrument is used to derive musical sounds produced by this instrument.

FIG. 3 is a more detailed block diagram of the program logic network 106, showing the elements of its construction and its outputs. A CD4040 type 12-bit ripple counter 128 has its Q10 through Q12 outputs 134 connected to a CD4028 type binary to octal converter 404. The converter 404 has its "zero" output connected as one input to OR gate 406 by line 408. The other input to OR gate 406 is the "3" output of the converter 404, supplied on line 410. The output of OR gate 406 is the melody inhibit signal.

The "1" output of converter 404 forms one input to OR gate 412 on line 414. A second input to OR gate 412 is supplied by the "zero" output of converter 404 on lines 416 and 418. A third input to OR gate 412 is supplied by the "4" output of converter 404 on line 420. The remaining input to OR gate 412 is supplied by the "7" output of converter 404 on line 422. The output of OR gate 412 is the countermelody inhibit signal.

The "1" signal is supplied on line 424 as one input to OR gate 426. A second input to OR gate 426 is supplied by the "zero" output of converter 404 on line 428. The remaining input to OR gate 426 is supplied by the "2" output of converter 404 on line 430. The output of OR gate 426 is the accompaniment inhibit signal.

The "zero" output of converter 404 is supplied in line 432 as one input to OR gate 434. The "1" output of converter 404 is supplied on line 436 as a second input to OR gate 434. The third input to OR gate 434 is supplied by the "7" output of converter 404 on line 438. The output of OR gate 434 is the melody load command signal.

The accompaniment load command and the advance pulse are supplied on line 416 as the "zero" output of converter 404.

FIG. 4A is an example of the resistance network 116 showing an example of resistor values and their connections between input lines 112 and output line 120. FIG. 4B is a similar representation of resistance network 114, showing an example of resistor values and their connections between input lines 110 and output line 118. FIG. 4C is a similar diagram of the resistors and their connections in resistance networks 220, 222, and 224, showing the inputs from integrated circuit chip 148 and the outputs to multiplexer 200. FIG. 4D is a corresponding diagram of the resistor values and connections for resistance network 226.

It should now be apparent to those skilled in the art that a unique automatic electronic musical instrument capable of achieving the stated objects of the invention has been provided. Because the musical frequency generation circuit employed in this invention will only produce combatible note combinations by transforming selected combinations that would otherwise be dissonant, no matter what combinations of inputs are activated, it is possible to apply unprocessed random signals as inputs and be guaranteed of a harmonious output. Similarly, any chord outputs from the circuit can be selected, and the chords so produced will be musically harmonious with the melody outputs. The use of circulating shift registers provides a suitable amount of structure and repetition to the songs produced, so that they are musically pleasing. The circuits controlling receipt of external signals give the instrument significant additional power to create music in response to external events.

It should further be apparent to those skilled in the art that various changes in form and detail of the invention as shown and described could be made. For example, the non-linear digital to analog resistance networks used to control the frequency of the rhythm and pitch VCOs, practical because this embodiment uses a highly stable and accurate wall-powered 12 volt power supply, could be replaced with a single crystal controlled oscillator and frequency divider/multiplier network to generate the necessary frequencies, as in the portable electronic musical instrument described in the above referenced U.S. Pat. No. 4,178,823. The pseudo-random number sequence could be made to have a selectable length, or different pseudo-random sequences could be selected for the shift registers 104, 130 and 132, by varying the organization of the exclusive OR gating of generator 100. The program counter 128 and PLA 106 could be replaced by a fourth shift register, the data input of which also was supplied by the pseudo-random sequence generator 100, thus producing pseudo-randomly varying song formats rather than a simple repeating format. It would also be desirable to provide a random access memory or other means for storing pseudo-random sequences generated by generator 100. Providing a means for varying the pseudo-random sequences, such as by reversing them, would allow variations of songs played by the instrument to be generated. It would also be possible to produce rhythmic effects that human musicians cannot easily produce by using two melody producing circuits whose rhythm clock ratios are small whole numbers with factors that are larger primes than two or three, for example 5 and 7 or 8 and 11. A syncopation effect could be produced by utilizing an assymetrical clock with different frequency wavelengths to drive the circuitry as described above. Electrically variable tone and envelope generating capability would provide enhanced pleasure for the listener. Synchronizing the pitch frequency of the automatic electronic musical instrument of this invention and a manually playable electronic musical instrument, such as described in U.S. Pat. No. 4,178,823, would make it easy for a human musician to jam with the automatic electronic musical instrument. If the chord logic were also synchronized, jamming together would be even easier. It is intended that these and other modifications be included within the spirit and scope of the claims appended hereto.

What is claimed is:

1. An automatic electronic musical instrument, which comprises:

means for generating an at least substantially random sequence of data bits, a first shift register having an input connected to receive a first portion of the at least substantially random sequence of data bits from said random sequence data bit generating means, said first shift register having a first and second plurality of outputs, means connected to receive input signals from the first and second plurality of outputs of said first shift register for generating rhythm and pitch signals in response to the input signals, a second shift register connected to receive a second portion of the at least substantially random sequence of data bits which is different than the first portion of data bits and the rhythm signal, said second shift register having a plurality of outputs, a musical frequency generating means including means for transforming dissonant frequency combinations selected for output from said frequency generating means to compatible frequency combinations and connected to receive the pitch signal from said pitch signal generating means and input signals from the plurality of outputs of said second shift register, said musical frequency generating means providing melody signal outputs in response to the pitch signals and the input signals from said second shift register, and means for selectively inhibiting the input signals to said musical frequency generating means from the plurality of outputs of said second shift register in accordance with a predetermined pattern.

2. The automatic electronic musical instrument of claim 1 additionally comprising means connected to receive an input signal from one of the outputs of said first shift register for selecting a time for music to be generated by said instrument.

3. The automatic electronic musical instrument of claim 1 in which said musical frequency generating means further includes a means for selecting from major and minor keys for the music to be generated by said instrument, said major and minor key selecting means being connected to receive an input signal from one of the outputs of said first shift register.

4. The automatic electronic musical instrument of claim 2 in which said time selection means comprises a third, variable length shift register and the time is selected by selecting one of the lengths of said third shift register.

5. The automatic electronic musical instrument of claim 4 in which said third shift register is connected to receive a third portion of the at least substantially random sequence of data bits of said at least substantially random sequence data bit generating means, which third portion is different than the first and second portions, said third shift register controlling generation by said musical instrument of an accompaniment for a melody generated by said musical frequency generation means in response to the pitch signal and the input signals from said second shift register.

6. The automatic electronic musical instrument of claim 1 in which the information in said second shift register is alternatively changeable by shifting the information in said second shift register or by loading new information from said at least substantially random sequence data bit generating means.

7. The automatic electronic musical instrument of claim 5 in which the information in said third shift register is alternatively changeable by shifting the information in said second shift register or by loading new information from said at least substantially random sequence data bit generating means.

8. The automatic electronic musical instrument of claim 1 in which information in said first shift register is changed periodically in response to a clocking signal supplied by said inhibiting means in accordance with a predetermined pattern.

9. The automatic electronic musical instrument of claim 8 in which the information in said first shift register is alternatively changed in response to the rhythm signal, supplied as a clocking signal to said first shift register.

10. The automatic electronic musical instrument of claim 1 in which said at least substantially random sequence data bit generating means is connected to receive the rhythm signal as a clocking pulse input.

11. The automatic electronic musical instrument of claim 1 in which said rhythm and pitch signal generating means comprises first and second resistance networks respectively connected to receive the input signals from the first and second plurality of outputs of said first shift register, and first and second voltage controlled oscillators respectively connected to receive output voltages from the first and second resistance networks.

12. The automatic electronic musical instrument of claim 1 additionally comprising means for receiving external signals, means for choosing from an output of said at least substantially random sequence data bit generator and the external signals received by said external signal receiving means for derivation of musical song patterns in said instrument, and means connected to supply an input based on the external signals to said first shift register.

13. The automatic electronic musical instrument of claim 12 in which said input supply means is a read only memory and said external signals are supplied as an address to said read only memory, contents of the read only memory constituting the input based on the external signals.

14. The automatic electronic musical instrument of claim 5, additionally comprising means for receiving external signals and means for selecting between an input based on the external signals and the third portion of said at least substantially random sequence of data bits of said at least substantially random sequence data bit generating means to be supplied to said third shift register.

15. The electronic musical instrument of claim 1 in which the at least substantially random sequence data bit generating means comprises a shift register having at least two outputs, each of which supplies one of said first and second data bit portions.

* * * * *